US006120306A

United States Patent [19]

Evans

[11] Patent Number: 6,120,306

[45] **Date of Patent: *Sep. 19, 2000**

[54] CAST COAX HEADER/SOCKET CONNECTOR SYSTEM

[75] Inventor: Robert F. Evans, Bedford, N.H.

[73] Assignee: Berg Technology, Inc., Reno, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/950,454

[22] Filed: Oct. 15, 1997

[51] Int. Cl.[7] ..... H01R 13/648

[52] U.S. Cl. ..... 439/101; 439/608; 439/931

[58] Field of Search ..... 439/608, 101, 439/108, 63, 931

[56] References Cited

U.S. PATENT DOCUMENTS

| | | | |
|---|---|---|---|
| 3,401,369 | 9/1968 | Palmateer et al. . | |
| 4,215,910 | 8/1980 | Walter | 339/143 R |
| 4,601,527 | 7/1986 | Lemke | 339/14 R |
| 4,749,368 | 6/1988 | Mouissie . | |
| 4,886,461 | 12/1989 | Smith . | |
| 4,975,066 | 12/1990 | Sucheski et al. | 439/63 |
| 5,076,800 | 12/1991 | Milnes et al. | 439/394 |
| 5,163,835 | 11/1992 | Morlion et al. . | |
| 5,169,325 | 12/1992 | Yaegashi et al. | 439/108 |
| 5,169,343 | 12/1992 | Andrews | 439/608 |
| 5,175,928 | 1/1993 | Grabbe | 29/884 |
| 5,277,592 | 1/1994 | Morlion . | |
| 5,330,371 | 7/1994 | Andrews | 439/579 |
| 5,387,764 | 2/1995 | Blom et al. | 174/261 |
| 5,456,616 | 10/1995 | Fuerst et al. | 439/620 |
| 5,518,422 | 5/1996 | Zell et al. | 439/608 |
| 5,577,935 | 11/1996 | Hartint et al. | 439/608 |
| 5,597,326 | 1/1997 | DeLessert et al. | 439/608 |
| 5,741,144 | 4/1998 | Elco et al. | 439/608 |

*Primary Examiner*—Gary F. Paumen
*Attorney, Agent, or Firm*—Brian J. Hamilla; M. Richard Page

[57] ABSTRACT

A connector for mounting to a circuit substrate comprising a housing and a connector pair supported by the housing. The connector pair includes a header connector having an electrically conductive connector housing, an opening in which an insulator element having a pin opening is disposed, a signal pin extending through the pin opening in the insulator element and through the connector housing and separated from the connector housing by the insulator element, and a raised cylindrical ground surface surrounding the insulator element the signal pin; and a socket connector, having a signal receptacle contact, a ground receptacle contact, and a dielectric separating element separating the signal contact and the ground contact from one another, so that, in mated condition, the signal contact mechanically connects and electrically contacts with the signal pin, and the ground contact mechanically connects and electrically contacts with the raised cylindrical ground surface.

46 Claims, 6 Drawing Sheets

CAST COAX HEADER/SOCKET CONNECTOR SYSTEM

FIELD OF THE INVENTION

The present invention relates in general to electrical connectors. More particularly, the present invention relates to electrical connectors having densely packed contact members capable of passing signals while minimizing crosstalk between adjacent contact members, especially at high frequencies.

BACKGROUND OF THE INVENTION

In electronic equipment, there is a need for electrical connectors providing connections in signal paths, and often the signal paths are so closely spaced that difficulties arise from interference between signals being transmitted along adjacent paths.

In order to minimize such difficulties it is known to provide grounding connections in such connectors, such connections serving in effect to filter out undesired interference between signal paths.

However, mere grounding is not always sufficient, and this is particularly so in connectors in which contacts constituting the signal paths through the connector extend through sharp angles, because interference between adjacent signal paths is a particularly large problem in such connectors.

In many situations where electrical signals are being carried among separate subassemblies of complex electrical and electronic devices, reduced size contributes greatly to the usefulness or convenience of the devices or of certain portions of them. To that end, extremely small conductors are now available, and it is practical to manufacture very closely spaced terminal pads accurately located on circuit boards or the like. It is therefore desirable to have a connector of reduced size, to interconnect circuit boards repeatedly, easily, and reliably, and with a minimum adverse effect on electrical signal transmission in a circuit including such a connector.

In high speed backplane applications, low crosstalk between signal currents passing through the connector is desirable. Low crosstalk allows the electronics to switch at higher frequencies without problems. Additionally, maximizing signal density is also desirable. High density increases the number of circuits that can be routed through the connector. However, as the density of devices and signals is increased, the problem of crosstalk increases. Moreover, as frequencies are increased, the crosstalk is exacerbated at the higher frequencies.

Although the art of electrical connectors is well developed, there remain some problems inherent in this technology, particularly densely packing contact members while preventing crosstalk between adjacent contact members. Therefore, a need exists for electrical connectors that have small footprints while maintaining signal integrity, and minimizing crosstalk at high frequencies.

SUMMARY OF THE INVENTION

The present invention is directed to a connector for mounting to a circuit substrate comprising a housing and a connector pair supported by the housing. The connector pair includes a header connector having an electrically conductive connector housing, an opening in which an insulator element having a pin opening is disposed, a signal pin extending through the pin opening in the insulator element and through the connector housing and separated from the connector housing by the insulator element, and a raised cylindrical ground surface surrounding the insulator element and the signal pin. The connector pair also includes a socket connector, having a signal receptacle contact, a ground receptacle contact, and a dielectric separating element separating the signal contact and the ground contact from one another, so that, in mated condition, the signal contact mechanically connects and electrically contacts with the signal pin, and the ground contact mechanically connects and electrically contacts with the raised cylindrical ground surface.

In the present invention, the dielectric separating element comprises a polyimide film and the connector housing is constructed from a one piece metallic casting.

In a further embodiment within the scope of the present invention, the socket connector further comprises a receptacle housing, and the socket connector is a right angle type of socket connector, the signal receptacle contact is a dual cantilevered signal receptacle contact, and the ground receptacle contact is a dual cantilevered ground receptacle contact. The dual cantilevered ground receptacle contact is external to the dual cantilevered signal receptacle contact.

In a further embodiment within the scope of the present invention, each of the cantilevered contacts of the socket connector is provided, on the front end thereof, with a portion that can mate with the associated pin or connection of the header connector, on the intermediate portion, with a right angle portion having a rectangular sectional shape, and on the securing or rear end portion thereof, with a terminal, respectively.

In another embodiment within the scope of this invention, the connector further comprises a receptacle housing, and the socket connector is a right angle type of socket connector, the signal receptacle contact is a dual cantilevered signal receptacle contact, and the ground receptacle contact is a single cantilevered ground receptacle contact. The single cantilevered ground receptacle contact is offset 90 degrees to the dual cantilevered signal receptacle contact.

The foregoing and other aspects of the present invention will become apparent from the following detailed description of the invention when considered in conjunction with the accompanying drawing.

DESCRIPTION OF EXEMPLARY EMBODIMENTS AND BEST MODE

The present invention is directed to an electrical connector pair having a compact profile that provides a coaxial-like electrical isolation of signal connections. The present invention provides signal isolation integrity within a contact engagement region in a minimized size profile.

Figure 1A:
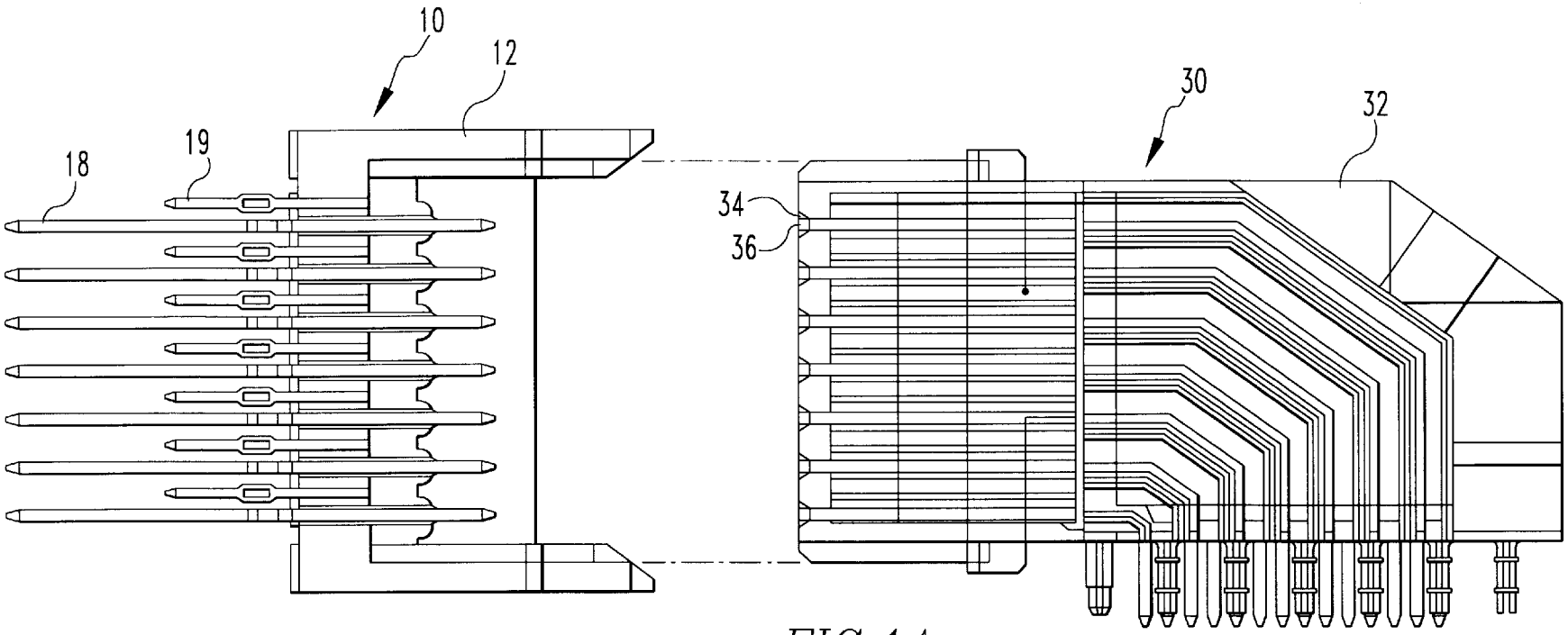
FIG. 1A is a sectional side elevational view of an embodiment of a high speed transmission connector, with the parts separated, according to the present invention.
Figure 1B:
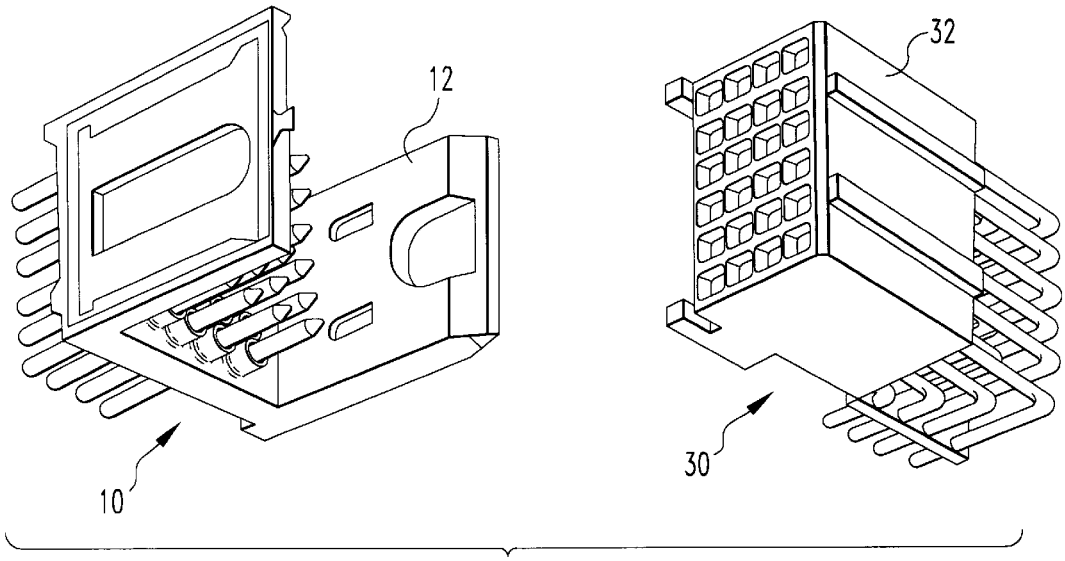
FIG. 1B is a perspective view of the connector of FIG. 1A, with the parts separated.

FIG. 1A is a sectional side elevational view of an embodiment of a high speed transmission connector, with the parts separated, according to the present invention. FIG. 1B is a perspective view of the connector of FIG. 1A, with the parts separated. A straight type of header connector 10 is comprised of a header housing 12 and pins (male contacts) 18 for a signal transmission line and pins (male contacts) 19 for a ground line. These pins 18 and 19 are alternately arranged in a plurality of rows on the header housing 12 of the associated connector 10. The pins are preferably stamped and formed with the preferred material being phosphor bronze or beryllium copper. The header housing 12 is preferably formed of an electrically conductive material. The signal pins 18 are electrically insulated from the housing 12. The ground pins 19 engage suitable ground connections in a motherboard. The header connector 10 can be mounted on or connected to a first printed card, called a motherboard.

A right angle type of socket connector 30 is comprised of a receptacle housing 32, ground receptacle contacts 34 for a ground line, and signal receptacle contacts 36 for a signal transmission line. A plurality of rows of the contacts 34 and 36 are regularly arranged so as to correspond to those formed by the pins 18 of the header connector 10. The socket connector 30 can be connected to or mounted on a second printed card, called a daughterboard. The contacts are preferably stamped and formed as described below.

Figure 2A:
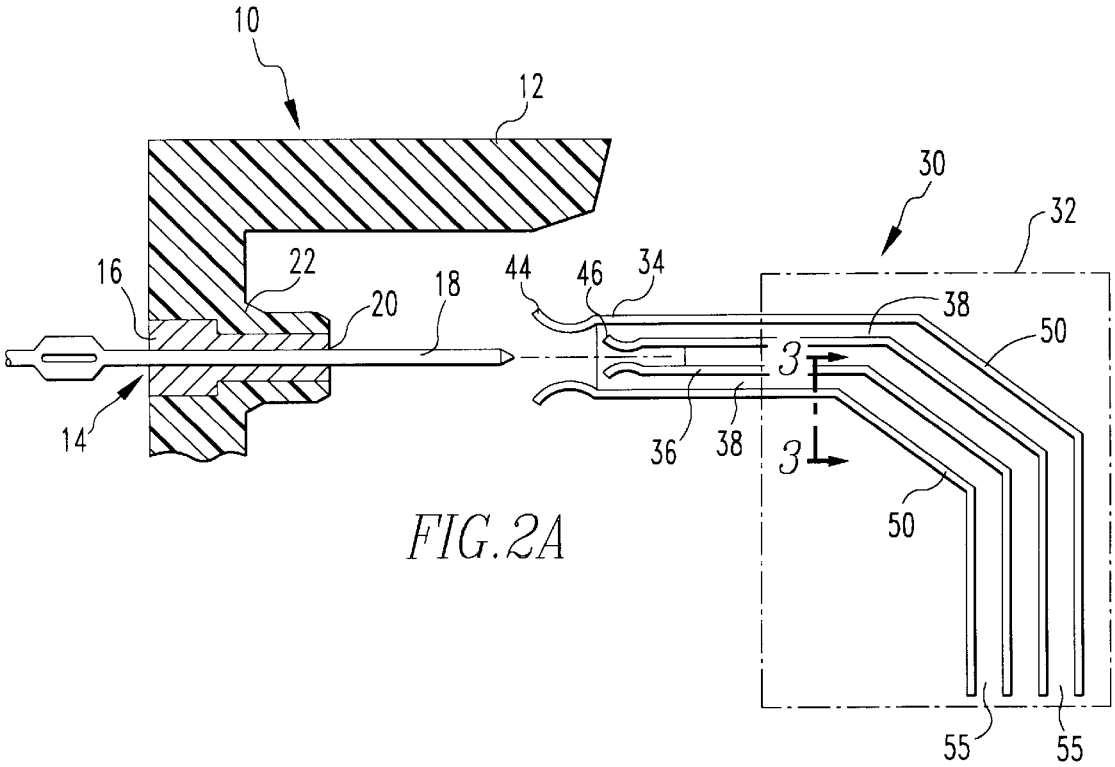
FIG. 2A is a sectional side view of an exemplary connector in accordance with the present invention.

FIG. 2A shows a side view of an exemplary connector pair, comprising a header connector 10 and a socket connector 30, in accordance with the present invention. FIG. 2A contains elements similar to those described above with respect to FIG. 1A. These elements are labeled identically. The header connector 10 is comprised of a connector housing 12. The connector housing 12 is preferably electrically conductive and formed of metal, preferably a one piece metallic casting, such as, for example, a zinc or magnesium die casting. The connector 10 has an opening 14 with an insulating insert or bushing 16, preferably comprising an insulating dielectric. A signal pin 18 is inserted through a pin opening 20 in the insulator bushing 16 and extends through the housing 12 and insulator bushing 16. The insulator bushing 16 is used to insulate the signal pin 18 from the metallic connector housing 12. The casting 12 has a raised surface 22, preferably cylindrical, around the bushing 16 which acts as a coaxial ground connection. The header connector 10 can be mounted on or connected to a first printed card, called a motherboard.

Figure 3:
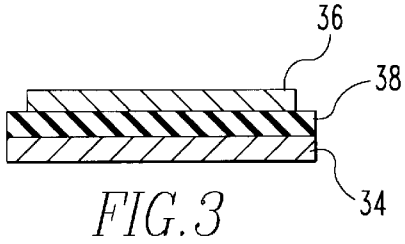
FIG. 3 is a cross-sectional view of FIG. 2A taken along the line 3—3.

A right angle type of socket connector 30 is comprised of a receptacle housing 32, schematically shown in FIG. 2A, a dual cantilevered ground receptacle contact 34, and a dual cantilevered signal receptacle contact 36. Preferably, the ground receptacle contact 34 is an outer contact, and the signal receptacle contact 36 is an inner signal contact. A dielectric material 38, preferably a polymeric dielectric material such as a polyimide film, separates the ground contact 34 from the signal contact 36, as shown in FIG. 3. Each of the cantilevered contacts 34, 36 of the socket connector 30 is provided, on the front end thereof, with a portion 44, 46 that can mate with the associated pin 18 or ground connection 22 of the header connector 10. Each of the cantilevered contacts 34, 36 is provided, on the intermediate portion 50, with a right angle shape having a rectangular sectional shape. Each of the cantilevered contacts 34, 36 is provided, on the securing or rear end portion thereof, with a terminal 55. The housing 32 is preferably molded, using a plastic material such as a high temperature thermoplastic.

The socket connector 30 can be connected to or mounted on a second printed card, called a daughterboard. By bringing the header connector 10 and the socket connector 30 together, the header connector 10 is mated with the socket connector 30, thereby connecting the motherboard to the daughterboard. When mated, the outer receptacle contact (the ground contact 34) mates with the cylindrical casting projection (the ground connection 22) and the inner receptacle contact (the signal contact 36) mates with the signal pin 18. In other words, the raised surface ground connection 22 engages the ground receptacle contact 34 to provide electrical isolation from other signal contacts that are within the connector pair in the contact engagement area. The socket connector 30 is formed of a composite which supports self-sustaining cantilevered arms. Alternatively, the metallic layers 34, 36 could be formed of conventional thickness contact materials.

Figure 2B:
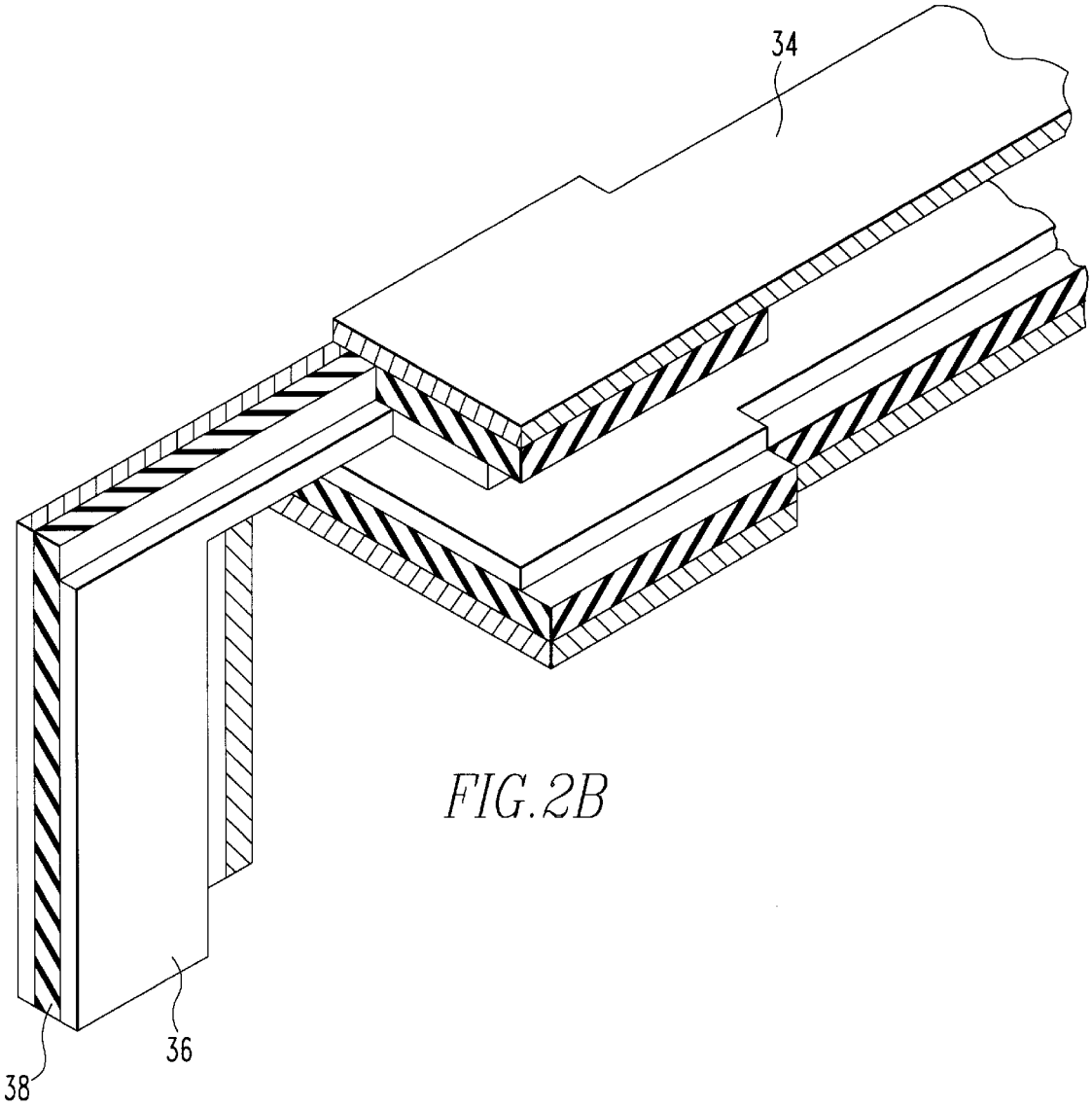
FIG. 2B is a perspective view of the socket connector of FIG. 2A.

FIG. 2B shows a perspective view of a preferred form of socket connector. As shown, the ground receptacle contact 34 is the outer contact, the signal receptacle contact 36 is the inner contact, and the contacts 34, 36 are separated by dielectric 38. Preferably the ground receptacle contact 34 comprises a phosphor bronze layer and has a thickness in the range between approximately 8 and 12 mils, and a preferred thickness of between approximately 8 and 10 mils. The dielectric layer 38 is preferably a polymeric dielectric material such as a polyimide film, which is applied or deposited in the form of an adherent sheet or layer on, and adheres to, the surface of the ground receptacle contact 34 to a thickness in the range between approximately 2 and 5 mils, and a preferred thickness of between approximately 2 and 4 mils. The signal receptacle contact 36 preferably comprises a copper layer adhered on or deposited on the dielectric layer 38 and has a thickness in the range between approximately 2 and 6 mils, and a preferred thickness of between approximately 2 and 4 mils. The contacts 30 are formed by stamping, bending, or otherwise forming the composite structure comprising the layers 34, 36, 38.

Figure 4:
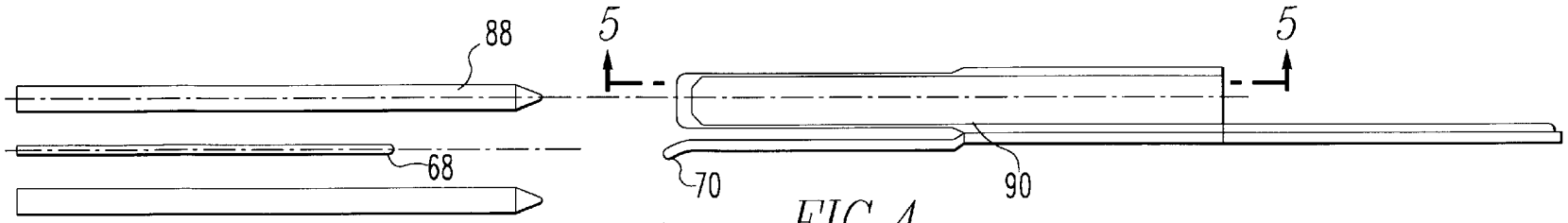
FIG. 4 is a side view of a further exemplary connector in accordance with the invention.

Another exemplary embodiment in accordance with the present invention is shown in FIG. 4. A single cantilever beam is used as the ground contact 70 and is offset 90 degrees from the signal contact 90. The signal contact 90 is preferably a dual beam contact that is substantially similar to the signal receptacle contact 36 of FIG. 2A, and makes electrical and mechanical contact with signal pin 88. The ground contact 70, when engaged with the header connector, makes electrical and mechanical contact with a ground surface, shown in FIG. 4 as element 68. It should be noted that element 68 comprises intermediate shields to electrically isolate the signal pins 88 from each other.

Figure 5:
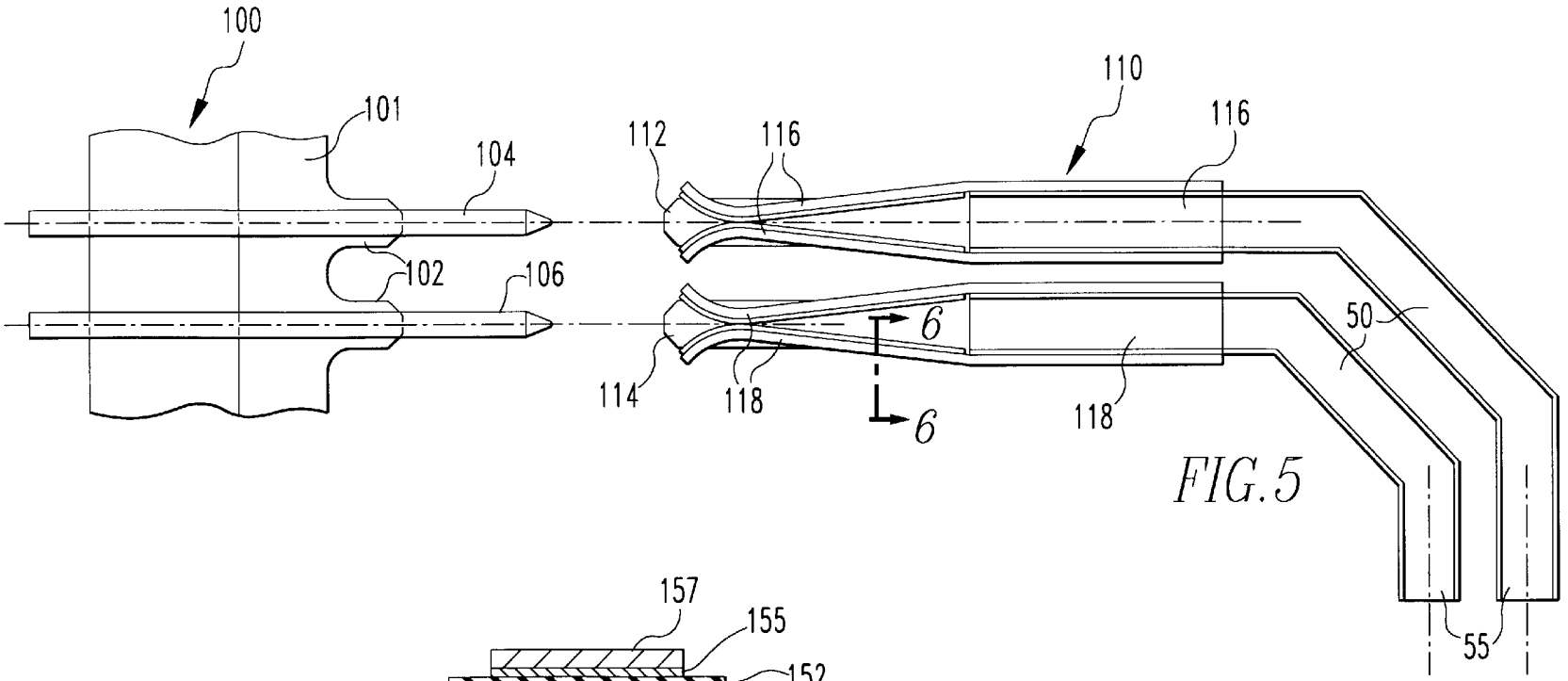
FIG. 5 is a view of the exemplary connector taken along the line 5—5 in FIG. 4.

A plurality of row and columns of the contacts of the connector pairs can be regularly arranged in a closely spaced array. FIG. 5 shows a plurality of signal pins 104, 106 inserted in a connector housing 101 that is within a header connector 100. Raised cylindrical surfaces 102 surround the signal pins 104, 106 and act as the ground connections. The signal pins 104, 106 and ground connections are substantially similar to the pins 18 and ground connections 22 in the header connector 10 of FIGS. 1 and 2. The header connector 100 has substantially the same coaxial arrangement at the base of the ground connections as in FIGS. 1 and 2. With respect to the socket connector side 110, single cantilever beams 112, 114 act as the ground receptacle contacts, and are shown in the view of FIG. 5 as being beneath signal receptacle contacts 116, 118. The ground receptacle contacts are provided to engage the ground connections 102, and the signal receptacle contacts 116, 118 are provided to engage the signal pins 104, 106, respectively.

Figure 6:
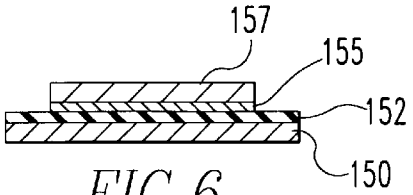
FIG. 6 is a cross-sectional view of FIG. 5 taken along the line 6—6.

FIG. 6 shows a cross-sectional view of FIG. 5 taken along the line 6—6. A base material 150 is used as a ground contact. Preferably the base material 150 comprises phosphor bronze and has a thickness in the range between approximately 8 and 12 mils, and a preferred thickness of between approximately 8 and 10 mils. A dielectric material 152, preferably a polymeric dielectric material such as a polyimide film, is applied or deposited in the form of an adherent sheet or layer on, and adheres to, the surface of the base material 150 to a thickness in the range between approximately 2 and 5 mils, and a preferred thickness of between approximately 2 and 4 mils. An adhesive 155 may be disposed on the surface of the dielectric material 152 to a preferred thickness of between approximately one-half and 1 mils. The adhesive is preferably acrylic or epoxy based and applied in sheet form. A signal contact 157 is patterned and deposited on the adhesive 155. Preferably, the signal contact comprises copper and has a thickness in the range between approximately 2 and 6 mils, and a preferred thickness of between approximately 2 and 4 mils.

Figure 7:
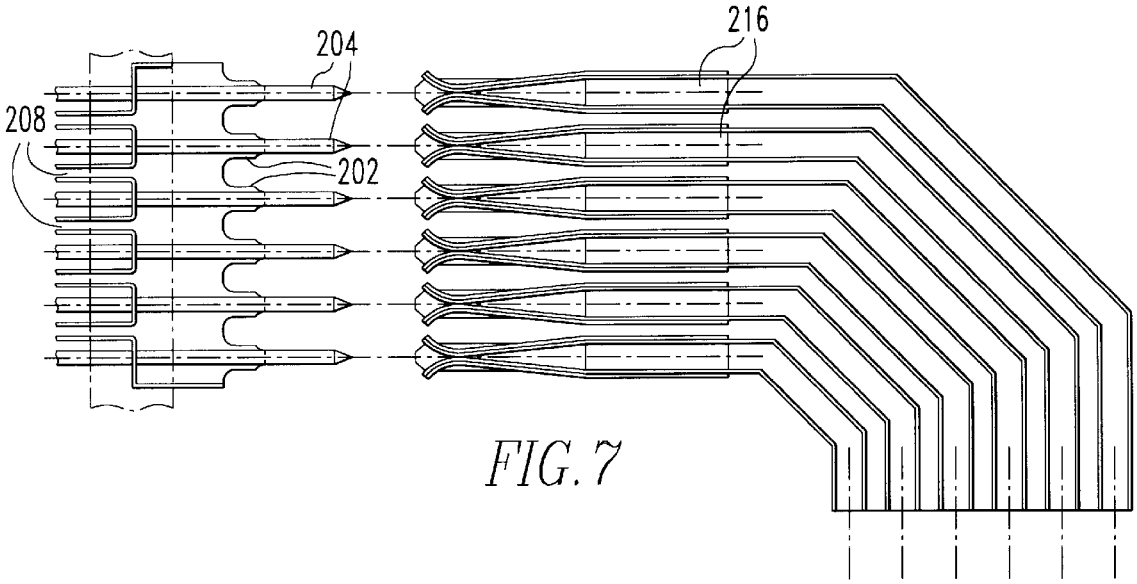
FIG. 7 shows a plurality of the connectors of FIG. 5 arranged in an array.
Figure 8:
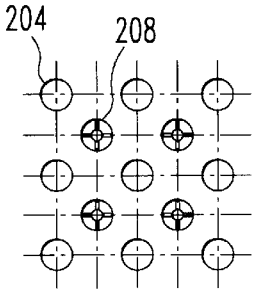
FIG. 8 shows an exemplary array pattern of the signal and ground pins.

FIG. 7 is similar to FIG. 5, and shows an array of six pairs of ground and signal receptacle contacts 216, six signal pins 204, and ground connections 202, preferably raised cylindrical surfaces. The signal pins 204 and ground connections 202 are substantially similar to the pins 18 and ground connections 22 in the header connector 10 of FIGS. 1 and 2. The header has substantially the same coaxial arrangement at the base of the ground connections as in FIGS. 1 and 2. The preferable pitch is 2 mm, and preferably a signal contact column is interposed between two adjacently located ground contact columns. The ground connections 202 are coupled to ground pins 208. The signal pins 204 and the ground pins 208 are preferably spaced in an interstitial array as shown in FIG. 8 to provide increased density while minimizing crosstalk. Although the exemplary embodiment of FIG. 7 shows six pairs of contacts and six signal pins, any number of contacts and pins can be used in an array of contacts and pins.

It should be noted that although the socket connector of the illustrated embodiments is provided with right angle portion, the present invention is not limited thereto. For example, the present invention can be applied to a socket connector (not shown) having a straight type ground contact and a straight type signal contact, without a right angle portion.

Although illustrated and described herein with reference to certain specific embodiments, the present invention is nevertheless not intended to be limited to the details shown. Rather, various modifications may be made in the details within the scope and range of equivalents of the claims and without departing from the invention.

What is claimed:

1. A connector for mounting to a circuit substrate comprising:

a housing; and a connector pair supported by said housing, said connector pair including:

a header connector having an electrically conductive connector housing, an opening in which an insulator element having a pin opening is disposed, a signal pin extending through said pin opening in said insulator element and through said connector housing and separated from said connector housing by said insulator element, and a raised ground surface surrounding said insulator element and said signal pin; and a socket connector, having a signal receptacle contact, a ground receptacle contact, and a dielectric film separating said signal contact and said ground contact from one another, so that, in mated condition, said signal contact mechanically connects and electrically contacts with said signal pin, and said ground contact mechanically connects and electrically contacts with said raised ground surface.

2. The connector of claim 1, further comprising an adhesive disposed between said dielectric film and said signal contact, wherein said dielectric film comprises a polyimide film.

3. The connector of claim 1, wherein said connector housing is constructed from a one piece metallic casting.

4. The connector of claim 1, wherein said socket connector further comprises a receptacle housing, and wherein said socket connector is a right angle type of socket connector, said signal receptacle contact is a dual cantilevered signal receptacle contact, and said ground receptacle contact is a dual cantilevered ground receptacle contact.

5. The connector of claim 4, wherein said dual cantilevered ground receptacle contact is external to said dual cantilevered signal receptacle contact.

6. The connector of claim 4, wherein each of the cantilevered contacts of the socket connector is provided, on the front end thereof, with a portion that can mate with the associated pin or connection of said header connector, on the intermediate portion, with a right angle portion having a rectangular sectional shape, and on the securing or rear end portion thereof, with a terminal, respectively.

7. The connector of claim 1, wherein said socket connector further comprises a receptacle housing, and wherein said socket connector is a right angle type of socket connector, said signal receptacle contact is a dual cantilevered signal receptacle contact, and said ground receptacle contact is a single cantilevered ground receptacle contact.

8. The connector of claim 7, wherein said single cantilevered ground receptacle contact is offset 90 degrees with respect to said dual cantilevered signal receptacle contact.

9. The connector of claim 7, wherein each of the cantilevered contacts of the socket connector is provided, on the front end thereof, with a portion that can mate with the associated pin or connection of said header connector, on the intermediate portion, with a right angle portion having a rectangular sectional shape, and on the securing or rear end portion thereof, with a terminal, respectively.

10. The connector of claim 1, wherein said raised surface ground surface is cylindrical.

11. The connector of claim 1, wherein said ground receptacle contact comprises phosphor bronze and has a thickness in the range between about 8 and 12 mils.

12. The connector of claim 11, wherein said thickness is in the range between about 8 and 10 mils.

13. The connector of claim 1, wherein said signal receptacle contact comprises copper and has a thickness in the range between about 2 and 6 mils.

14. The connector of claim 13, wherein said thickness is in the range between about 2 and 4 mils.

15. The connector of claim 1, wherein said dielectric film has a thickness in the range between about 2 and 5 mils.

16. The connector of claim 15, wherein said thickness is in the range between about 2 and 4 mils.

17. The connector of claim 1, wherein said raised ground surface is an integral boss that forms a coaxial shield around a portion of said signal pin.

18. The connector of claim 17, wherein said portion of said signal pin is the base of said signal pin.

19. A connector pair for mounting to a circuit substrate comprising:

a header connector having an electrically conductive connector housing, an opening in which an insulator element having a pin opening is disposed, a signal pin extending through said pin opening in said insulator element and through said connector housing and separated from said connector housing by said insulator element, and a raised ground surface surrounding said insulator element and said signal pin; and a socket connector, having a signal receptacle contact, a ground receptacle contact, and a dielectric film separating said signal contact and said ground contact from one another, so that, in mated condition, said signal contact mechanically connects and electrically contacts with said signal pin, and said ground contact mechanically connects and electrically contacts with said raised ground surface.

20. The connector pair of claim 19, further comprising an adhesive disposed between said dielectric film and said signal contact, wherein said dielectric film comprises a polyimide film.

21. The connector pair of claim 19, wherein said connector housing is constructed from a one piece metallic casting.

22. The connector pair of claim 19, wherein said socket connector further comprises a receptacle housing, and wherein said socket connector is a right angle type of socket connector, said signal receptacle contact is a dual cantilevered signal receptacle contact, and said ground receptacle contact is a dual cantilevered ground receptacle contact.

23. The connector pair of claim 22, wherein said dual cantilevered ground receptacle contact is external to said dual cantilevered signal receptacle contact.

24. The connector pair of claim 22, wherein each of the cantilevered contacts of the socket connector is provided, on the front end thereof, with a portion that can mate with the associated pin or connection of said header connector, on the intermediate portion, with a right angle portion having a rectangular sectional shape, and on the securing or rear end portion thereof, with a terminal, respectively.

25. The connector pair of claim 19, wherein said socket connector further comprises a receptacle housing, and wherein said socket connector is a right angle type of socket connector, said signal receptacle contact is a dual cantilevered signal receptacle contact, and said ground receptacle contact is a single cantilevered ground receptacle contact.

26. The connector pair of claim 25, wherein said single cantilevered ground receptacle contact is offset 90 degrees with respect to said dual cantilevered signal receptacle contact.

27. The connector pair of claim 25, wherein each of the cantilevered contacts of the socket connector is provided, on the front end thereof, with a portion that can mate with the associated pin or connection of said header connector, on the intermediate portion, with a right angle portion having a rectangular sectional shape, and on the securing or rear end portion thereof, with a terminal, respectively.

28. The connector pair of claim 19, wherein said raised surface ground surface is cylindrical.

29. The connector pair of claim 19, wherein said ground receptacle contact comprises phosphor bronze and has a thickness in the range between about 8 and 12 mils.

30. The connector pair of claim 29, wherein said thickness is in the range between about 8 and 10 mils.

31. The connector pair of claim 19, wherein said signal receptacle contact comprises copper and has a thickness in the range between about 2 and 6 mils.

32. The connector pair of claim 31, wherein said thickness is in the range between about 2 and 4 mils.

33. The connector pair of claim 19, wherein said dielectric film has a thickness in the range between about 2 and 5 mils.

34. The connector pair of claim 33, wherein said thickness is in the range between about 2 and 4 mils.

35. The connector pair of claim 19, wherein said raised ground surface is an integral boss that forms a coaxial shield around a portion of said signal pin.

36. The connector pair of claim 35, wherein said portion of said signal pin is the base of said signal pin.

37. A shielded terminal structure of an electrical connector adapted to engage a signal contact and ground on a mating electrical connector, comprising:

a signal contact having a mating end adapted to engage the signal contact of the mating connector;

a shielding contact adapted to engage the ground of the mating connector, located adjacent said signal contact and at least overlying said mating end of said signal contact; and an insulating film disposed at least between said mating end of said signal contact and said shielding contact to join and electrically separate said signal contact and said shielding contact from one another.

38. The shielded terminal structure as recited in claim 37, wherein said signal contact, shielding contact and said insulating film are formed from a composite structure having:

a first conductive layer with a thickness of between approximately 2 and 6 mils;

a second conductive layer with a thickness between approximately 8 and 12 mils; and a dielectric material located between said first and second conductive layers and having a thickness between approximately 2 and 5 mils.

39. The shielded terminal structure as recited in claim 38, wherein said first conductive layer is phosphor bronze.

40. The shielded terminal structure as recited in claim 38, wherein said thickness of said first conductive layer is between approximately 2 and 4 mils.

41. The shielded terminal structure as recited in claim 38, wherein said second conductive layer is copper.

42. The shielded terminal structure as recited in claim 38, wherein said thickness of said second conductive layer is between approximately 8 and 10 mils.

43. The shielded terminal structure as recited in claim 38, wherein said insulating film is a polymer.

44. The shielded terminal structure as recited in claim 43, wherein said polymer is polyimide.

45. The shielded terminal structure as recited in claim 38, wherein said thickness of said insulating film is between approximately 2 and 4 mils.

46. The shielded terminal structure as recited in claim 37, wherein said insulating film is disposed between said signal contact and said shielding contact for generally the entire length of said signal contact.

* * * * *